United States Patent [19]

Barlow

[11] Patent Number: 4,972,773

[45] Date of Patent: Nov. 27, 1990

[54] REGISTRATION SYSTEM FOR SILK SCREEN EQUIPMENT

[76] Inventor: Walter T. Barlow, 290 S. Thibodeaux, Ponchatoula, La. 70454

[21] Appl. No.: 451,605

[22] Filed: Dec. 19, 1989

[51] Int. Cl.[5] ..... B05C 17/06

[52] U.S. Cl. ..... 101/127.1; 101/128.1

[58] Field of Search ..... 101/127.1, 126, 127, 101/128, 128.1, 128.4, 129, 123

[56] References Cited

U.S. PATENT DOCUMENTS

| | | | |
|---|---|---|---|
| 3,859,917 | 1/1975 | Bubley et al. | 101/126 |
| 3,889,629 | 6/1975 | Black | 101/123 |
| 3,971,312 | 7/1976 | Carli | 101/128.1 |
| 4,075,968 | 2/1978 | Caddock | 101/126 |
| 4,111,118 | 9/1978 | Green et al. | 101/123 |
| 4,315,461 | 2/1982 | Harpold | 101/126 |
| 4,381,706 | 5/1983 | Harpold | 101/127.1 |
| 4,388,862 | 6/1983 | Thomas, Jr. | 101/128.1 |
| 4,517,894 | 5/1985 | Davis et al. | 101/126 |
| 4,907,506 | 3/1990 | Davis et al. | 101/127.1 |

*Primary Examiner*—Eugene H. Eickholt

*Attorney, Agent, or Firm*—Fleit, Jacobson, Cohn, Price, Holman & Stern

[57] ABSTRACT

A registration system to enable accurate registration of a silk screen in relation to a printing surface which enables adjustment of the silk screen in a simple and efficient manner. The registration system includes support clamps for the silk screen frame together with mounting means for the support clamps which can be easily adjusted by rotating a single, large and readily accessible knob with the mounting structure for the silk screen being counterbalanced by an eccentric weight with the features of the registration system cooperating to enable accurate registration of the silk screen during multiple color printing operations.

9 Claims, 1 Drawing Sheet

REGISTRATION SYSTEM FOR SILK SCREEN EQUIPMENT

BACKGROUND OF THE INVENTION

1. Field of the Invention

The present invention generally relates to silk screen printing equipment and more specifically a registration system to enable accurate registration of a silk screen in relation to a printing surface which enables adjustment of the silk screen in a simple and efficient manner. The registration system includes support clamps for the silk screen frame together with mounting means for the support clamps which can be easily adjusted by rotating a single, large and readily accessible knob with the mounting structure for the silk screen being counterbalanced by an eccentric weight with the features of the registration system cooperating to enable accurate registration of the silk screen during multiple color printing operations.

2. Information Disclosure Statement

Silk screen printing processes are well-known in which a silk screen is engaged with a printing surface such as a fabric surface and the like and colors are printed on the surface by a roller or squeegee associated with the silk screen. When printing multi-color designs on a printing surface, successive silk screens are used to print the various colors thus requiring accurate registration of the silk screens in relation to the printing surface. Various structures have been provided to support the printing surface and the silk screen frames including rotatable turntables with spring-type or gas-type counterbalancing devices being provided for the silk screen frames all of which have enabled silk screen printing processes to be practiced. The following U.S. patents disclose structures relating to silk screen printing processes.

U.S. Pat. Nos. 2,613,595
2,796,831
2,881,700
3,098,431
3,427,964
4,084,504

While silk screen printing has been practiced and various improvements have been made in the basic process, including the improvements disclosed in the above listed patents, none of the above patents disclose the particular structure of this invention for adjustably supporting and counterbalancing the silk screen to enable more accurate registration of the silk screen with the printing surface.

SUMMARY OF THE INVENTION

An object of the present invention is to provide a registration system for silk screen equipment which enables accurate registration of the silk screen with a printing surface without requiring the use of tools to adjust the screen with the structure of this invention enabling easy rotation of one knob to adjustably place the screen in a secure position and in an accurate registration position.

Another object of the invention is to provide a registration system for silk screen equipment in accordance with the preceding object in which a relatively large, easily accessible and easily grasped knob can be turned to secure the silk screen in registration to provide perfect multi-color printing jobs.

A further object of the invention is to provide a registration system for silk screen equipment in accordance with the preceding objects in which the silk screen frame is counter-balanced by a counterweight system which can be varied to enable the screen to be lowered and lifted with minimum stress on the screens and providing advantages in operation as compared to counterbalancing with coil springs or gas springs.

Still another object of the invention is to provide a registration system for silk screen equipment to enable multi-color printing which can be used with various turntable and locking structures with the adjustable mounting of the silk screens of this invention enabling quick and easy registration of the silk screen with a printing surface with manipulation of the structure being quite simple thereby enabling the device to be easily used by individuals operating a turntable type of silk screen printing equipment.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
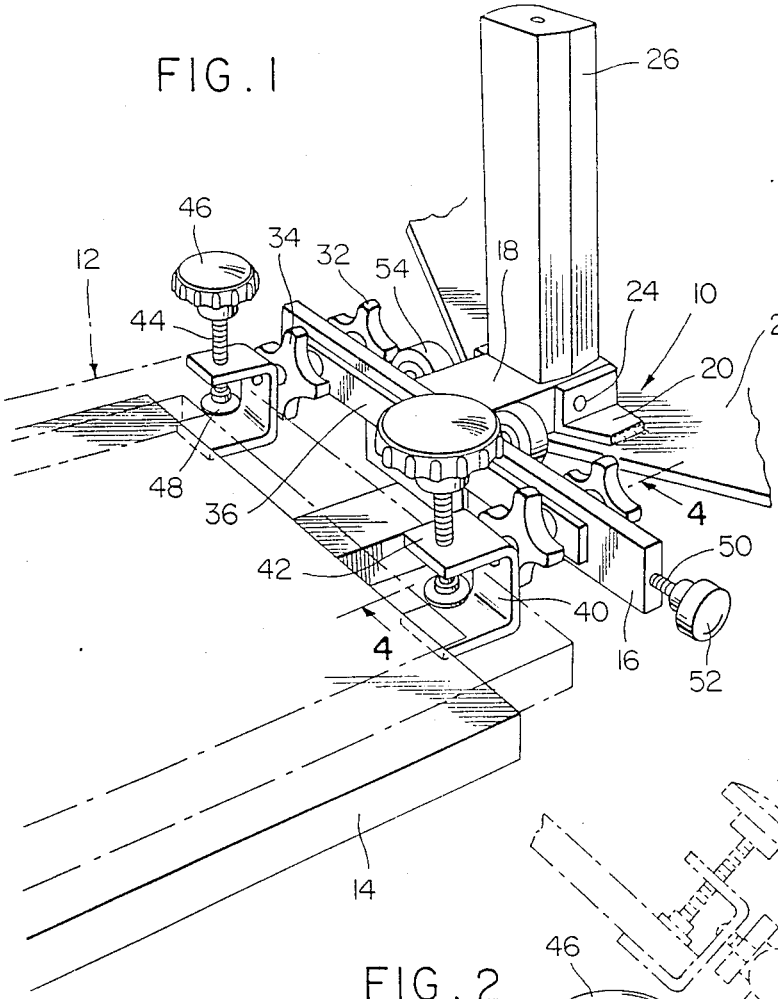
FIG. 1 is a perspective view of the registration system for silk screen equipment of the present invention illustrating the specific structure of the silk screen supporting clamps and related structure.
Figure 4:
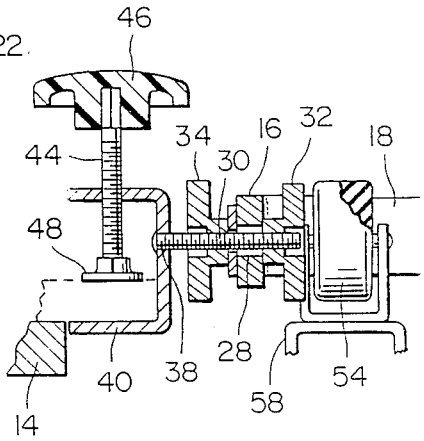
FIG. 4 is a transverse, sectional view taken substantially upon a plane passing along section line 4—4 on FIG. 1 illustrating further structural details of the invention.
Figure 2:
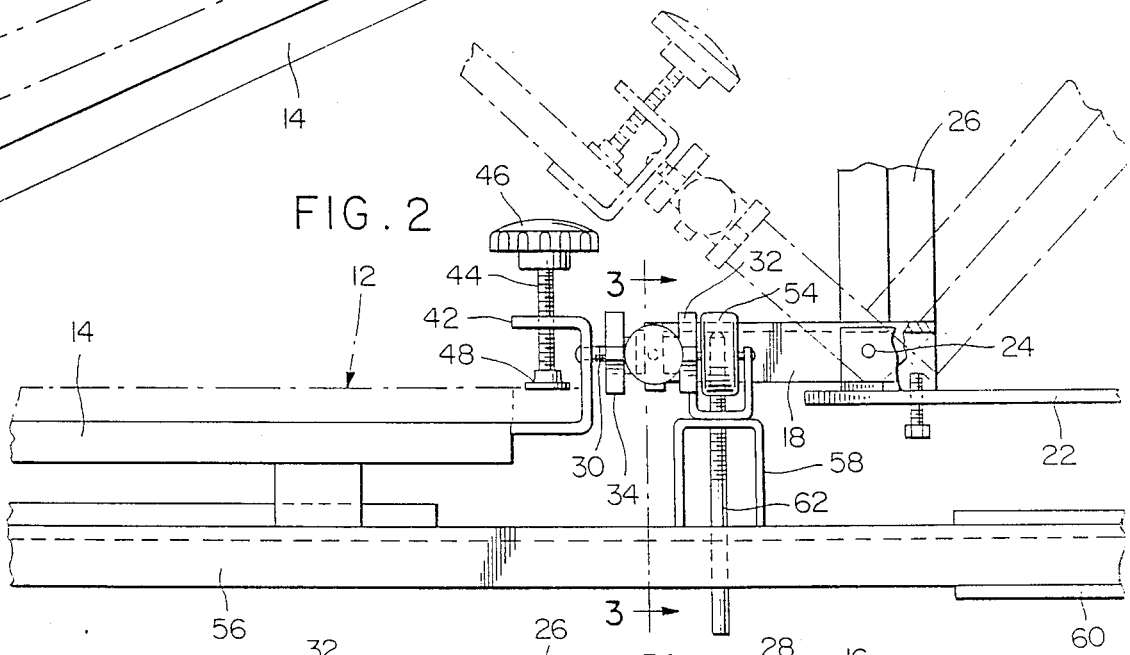
FIG. 2 is a side elevational view of the invention with parts shown in section.
Figure 3:
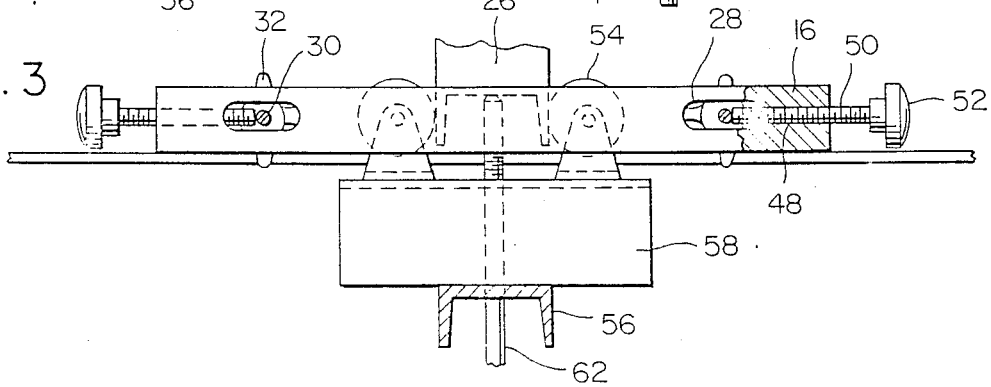
FIG. 3 is a longitudinal, sectional view taken substantially upon a plane passing section line 3—3 on FIG. 2 illustrating further structural details of the mounting structure for the silk screen.

Referring now specifically to the drawings, the registration system of the present invention is generally designated by reference numeral 10 and supports a silk screen generally designated by numeral 12 in an adjustable position in relation to a printing surface 14.

The registration system includes a support bar 16 in the form of an elongated rigid bar of rectangular cross-sectional configuration having its major width diameter disposed vertically. Centrally of the support bar is a laterally extending support member 18 integral therewith which is pivotally supported by bracket members 20 connected to a turntable 22 by welding or any other fastening means to enable pivotal movement of the support member and support bar about a pivot bolt 24 extending through the brackets 20 and the support member 18. An elongated weight 26 in the form of a bar is connected to the support member 18 in eccentric relation to the pivot axis of the bolt 24.

The support bar includes a pair of longitudinally spaced, horizontally elongated slots 28 therein receiving a fastening bolt 30 having a handwheel 32 on one end thereof engaging the support bar 16 and a handwheel 34 on the other end thereof for engaging a connecting bar 36 having apertures which receive the bolt 30. Also, the bolt 30 is threaded into a threaded aperture 38 in the bight 40 of a vertically disposed C-clamp or U-clamp 42 having a threaded clamp screw 44 extending through the upper leg thereof with the clamp screw 44 including a knob 46 on the outer end thereof and a clamp plate 48 on the inner end thereof for clampingly engaging the silk screen 12. Thus, the two clamps 42 clampingly engage the silk screen frame and support it from the support bar 16 with the clamps and connecting bar 36 being longitudinally adjustable along the length of the support bar 16 within the limits defined by the slots 28. The handwheels 32 and 34 also enable lateral adjustment of the clamps 42. The support bar includes a longitudinal internally threaded bore 48 threadedly receiving an adjustment screw 50 which extends longitudinally through the threaded bore 48 into the slot 28 with the outer end of the threaded member 50 having a large knob 52 thereon and the inner end thereof engaging the bolt 30 to adjust the bolt 30 longitudinally in the slots 28.

This structure enables the silk screen to be accurately positioned and registered with the printing surface 14 with the turntable 22 being secured in rotated position by a pair of spaced wheels 54 which receive the support member 18 therebetween which secures the support member 18 in place. The adjustment knob 52 enables accurate adjustment of the silk screen in relation to the printing surface thus providing a fine adjustment of the silk screen for accurate registration of the silk screen with the printing surface. A simple rotation of the knob 52 places the silk screen into a position for accurate and secure registration thereby enabling accurate multiple color printing jobs to be effectively completed. The use of the counterweight system instead of coil springs or gas springs facilitates the screen being lowered or lifted with minimum stress on the screen. The eccentric weight 26 may be adjusted by adding or removing separable weights thus enabling the counterweight to be used with smaller or larger silk screens. The printing surface 14 can be radially adjusted by a clamp device adjustably mounting the printing surface 14 on a support arm or channel-shaped radial member 56 thus allowing the printing surface to slide in and out to accommodate different print areas. The turntable is of conventional construction and includes effective bearing structures and enabling the printing surface turntable and the turntable which supports the silk screens to be rotated independent of each other thereby further facilitating registration of the silk screen with the printing surface.

Also, the wheels 54 are mounted from arm 56 by a bracket structure 58 and the arms are connected with a lower turntable 60. An adjustable stop screw 62 may be mounted on arm 56 to limit downward pivotal movement of support 18 and silk screen 12.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A registration system for silk screen printing equipment which includes a printing surface and a silk screen movable vertically toward and away from the printing surface, said system comprising a pair of support clamp members adapted to clampingly engage a silk screen frame at spaced points, a support bar in supporting engagement with said clamp members, a counterweighted support member connected with said support bar and adapted to be pivotally supported from a turntable of silk screen printing equipment, and means interconnecting said clamp members and said support bar to adjust the clamp members longitudinally in relation to the support bar thereby positioning the silk screen accurately in relation to the printing surface.

2. The structure as defined in claim 1 wherein said means supporting the clamp members from the support bar including a pair of longitudinally spaced and longitudinally elongated slots in said support bar, each of said clamp members including a threaded support bolt extending through the slots in the support bar and a pair of threaded members on said bolt to clampingly secure the bolt in longitudinally adjusted position in said slots, said support bar including at least one screw threaded member extending through a screw threaded bore in the end of the support bar with the inner end thereof adapted to engage the bolt extending through the slot for adjusting the bolt longitudinally in the slot.

3. The structure as defined in claim 2 wherein said threaded member includes an enlarged knob on the outer end thereof to enable adjustment of the bolts in the slots by rotating the knob.

4. The structure as defined in claim 3 together with a connecting bar extending between the bolts to maintain them in fixed spaced relation whereby a single screw threaded member and knob can adjust both bolts in relation to the slots.

5. The structure as defined in claim 4 wherein said threaded members on the bolt connected with each of the clamp members includes internally threaded handwheels to enable the clamp members and bolts to be adjusted laterally in relation to the support bar.

6. The structure as defined in claim 5 wherein each of said clamp members is generally a U-shaped clamp having spaced parallel upper and lower legs interconnected by a bight portion, said threaded bolt being connected to the bight portion and the upper leg of each clamp member having a clamp screw extending therethrough for securing a silk screen frame in place in the clamp member.

7. The structure as defined in claim 6 together with a pair of spaced wheels to guide and position the support member when the support bar and silk screen are pivoted to a position with the silk screen adjacent the printing surface, said wheels being supported from a radial support arm connected to the silk screen printing equipment.

8. In combination with silk screen equipment including a pair of vertically spaced turntables with the lower turntable including at least one laterally extending support arm having a printing surface mounted thereon, the upper turntable including support means for a silk screen to enable the silk screen to be lowered to engage with a printing surface, said support means comprising bracket means adapted to be connected to the upper turntable, an L-shaped support member including a weight on one end to counterbalance the support member, pivot means connecting the support member to the brackets and means on the support member adjustably supporting a silk screen for movement toward and away from the printing surface.

9. The combination as defined in claim 8 wherein said support member includes a longitudinally elongated support bar rigid with the outer end thereof, a pair of clamp members adapted to be clampingly engaged with a silk screen frame and means connecting the clamp members to the support bar for longitudinal adjustable movement in relation to the support bar and support member to enable accurate positioning of the silk screen in relation to the printing surface.

* * * * *